US005277658A

United States Patent [19]

Goettl

[11] Patent Number: 5,277,658

[45] Date of Patent: Jan. 11, 1994

[54] BAROMETRIC DAMPER APPARATUS

[76] Inventor: George M. Goettl, 6801 N. 12th Ave., Phoenix, Ariz. 85013

[21] Appl. No.: 993,691

[22] Filed: Dec. 21, 1992

[51] Int. Cl.[5] ..... F24F 13/14

[52] U.S. Cl. ..... 454/259; 137/512.1; 454/360

[58] Field of Search ..... 137/512.1; 454/259, 454/351, 352, 353, 359, 360

[56] References Cited

U.S. PATENT DOCUMENTS 3,204,548 9/1965 McCabe ..... 454/352

*Primary Examiner*—Harold Joyce

*Attorney, Agent, or Firm*—H. Gordon Shields

[57] ABSTRACT

Barometric damper apparatus is usable for both horizontal air flow and vertical air flow and thus comprises a universal barometric damper apparatus without a structural change. The barometric damper apparatus includes a plurality of louvers or damper blades pivotly secured to a frame and which pivot to the closed position under gravity when air stops flowing. Each louver includes a relatively short upstream portion and a relatively long downstream portion, with the relatively short upstream portion including a counterweight which causes the relatively short upstream portion to be heavier than the relatively long downstream portion so that the louver apparatus pivots to the closed position with the relatively short upstream portion always moving downwardly. A bend in the relatively long downstream portion allows the louver to contact the adjacent louver in the closed position so as to provide a seal to prevent air from leaking back through the damper apparatus.

8 Claims, 2 Drawing Sheets

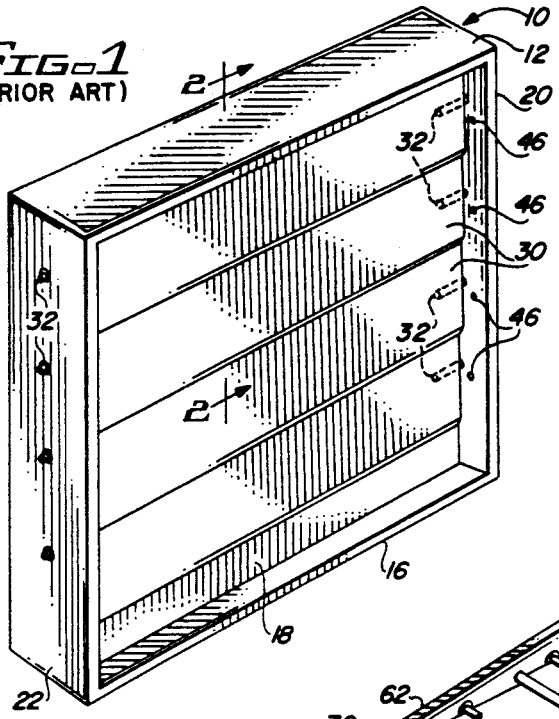
FIG. 1
(PRIOR ART)
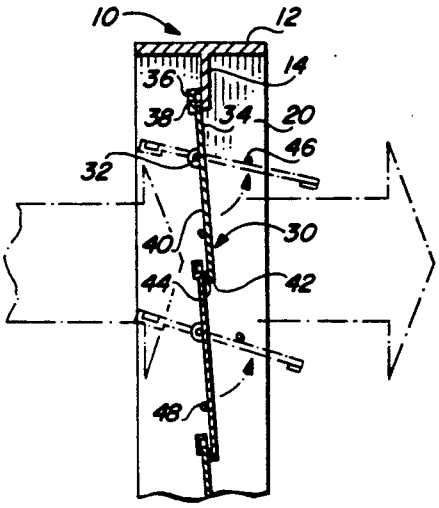
FIG. 2
(PRIOR ART)
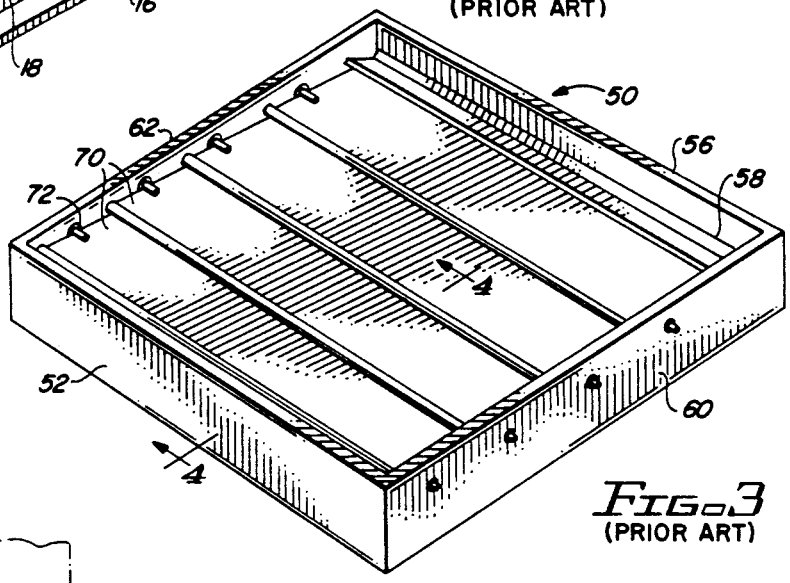
FIG. 3
(PRIOR ART)
FIG. 4
(PRIOR ART)
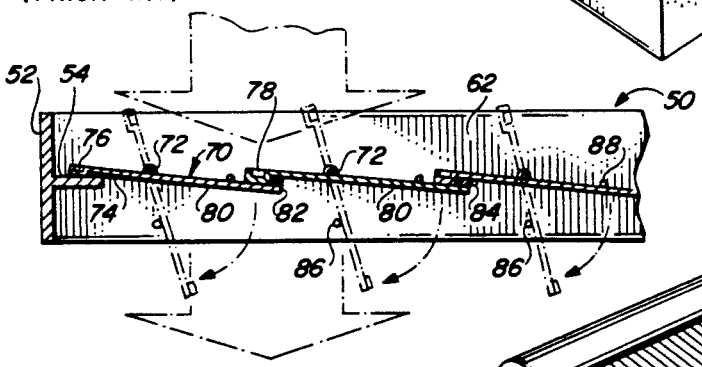
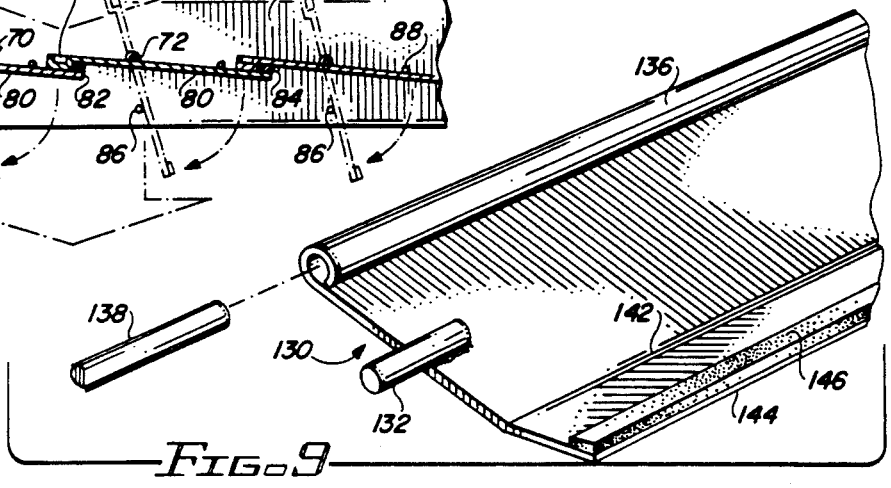
FIG. 9

BAROMETRIC DAMPER APPARATUS

BACKGROUND OF THE INVENTION

1. Field of the Invention

This invention relates to barometric damper apparatus, or self-closing louver apparatus useful particularly in the Heating, Ventilating, and Air Conditioning (HVAC) industry and, more particularly, to barometric damper apparatus that may be interchangeably used for both side draft and down draft applications without structural changes.

2. Description of the Prior Art

Barometric damper apparatus comprises louver elements which open and close automatically in response to a flow of air. When there is an air flow, as an air moving device such as a fan or blower is operating, the barometric damper apparatus, or the louvers open to allow the flow of air through the louvers. When the blower is turned off, the flow of air ceases and the barometric damper apparatus, or the plurality of louvers, close. The opening and closing is in response to the flow of air, and specifically to the weight and balance and pivoting action of the damper or louver elements. Typically, the damper elements, or louvers, pivot between the "top" and "bottom" edges. That is, the louvers are balanced in such a manner that a positive or negative flow of air will cause the dampers to pivot to a generally parallel orientation when there is a flow of air against, and between, the louvers of the damper. When the flow of air ceases, or reverses, the elements pivot by gravity to close, thus preventing air from traveling back through the apparatus in the opposite direction to the desired air flow.

In prior art, there are required two different designs for barometric dampers, depending on their particular placement. There is a barometric damper of a particular weight design required for a side draft application, and a different weight designed barometric damper for a down draft application. The two barometric damper designs of the prior art are not interchangeable. The apparatus of the present invention is interchangeable.

Since two different designs of barometric dampers are required in the field, or at a job site, according to a particular installation, it is obvious that an inventory must be kept for both types of damper. When an order comes in for a particular damper, only that type of damper design must be sent to the job site. Unfortunately, confusion is inevitable, and it has been suggested that there is probably an error rate of as much as fifteen percent (15%) of all installations in the ordering of the barometric damper apparatus. Naturally, this leads to much lost time on both the part of the installer and the part of the wholesaler or supplier. The required paperwork is obviously also affected and represents financial losses.

A primary difference between down draft and side draft barometric damper designs is in the weight, or in the weight distribution, of the louver blade elements. The weight involved in the down draft elements is greater than that of the side draft elements because the down draft elements must close against the force of gravity for a substantial amount of weight. That is, in returning to a generally horizontal alignment in the closed position, each louver element must pivot against a gravitational force, whereas in the side draft louver elements the pivoting action is generally primarily with the force of gravity.

The apparatus of the present invention overcomes the deficiencies of the prior art by providing a barometric damper apparatus which is usable, and thus interchangeable for both down draft and side draft applications without structural changes to the apparatus.

SUMMARY OF THE INVENTION

The invention described and claimed herein comprises a barometric damper apparatus usable for both side draft and down draft applications. Louver elements or blades are appropriately aligned with each other. The louver elements or blades pivot in response to positive or negative air pressure to open to allow the flow of air and they return to a closed position when the air flow stops. Each louver blade includes a bent portion or break adjacent to the top of each louver blade. The balance of the blades is such, from their pivot point or pivot line, that the blades will open and close completely both in a side draft or vertical orientation and in a down draft or horizontal orientation. When air flow ceases or reverses, the blades pivot to their closed positions to prevent the inadvertent back flow of air in the system.

Among the objects of the present invention are the following:

To provide new and useful barometric damper apparatus;

To provide new and useful barometric damper apparatus usable for both down draft and side draft air flow systems;

To provide new and useful universal barometric damper apparatus usable in both horizontal and vertical orientations;

To provide new and useful blade elements in a barometric damper apparatus; and

To provide new and useful barometric damper apparatus in which blade elements include a bent portion.

BRIEF DESCRIPTION OF THE DRAWING

FIG. 1 is a perspective view of one type of prior art barometric damper apparatus.

FIG. 2 is a view in partial section taken generally along line 2—2 of FIG. 1.

FIG. 3 is a perspective view of another prior art barometric damper apparatus.

FIG. 4 is a view in partial section taken generally along line 4—4 of FIG. 3.

FIG. 9 is an exploded perspective view of a portion of the apparatus of the present invention.

DESCRIPTION OF THE PREFERRED EMBODIMENT

Figure 5:
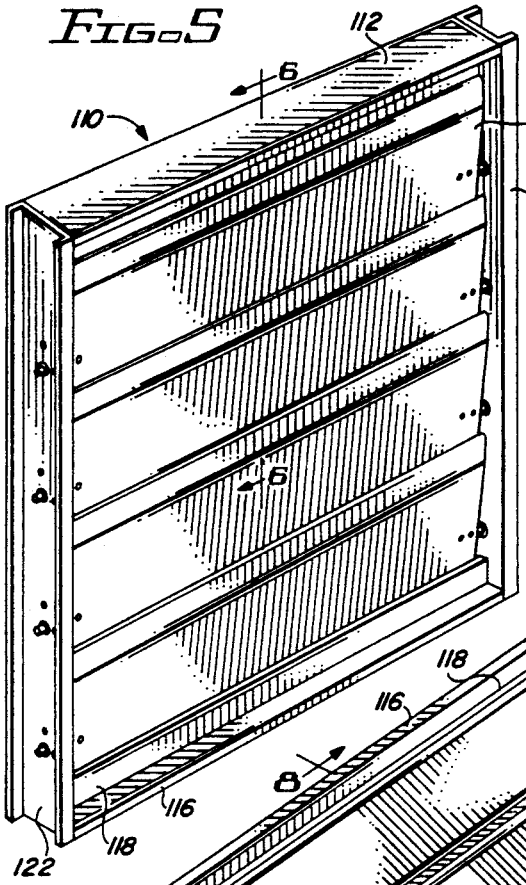
FIG. 5 is a perspective view of barometric damper apparatus of the present invention in a generally vertical orientation.

FIG. 1 is a perspective view of barometric damper apparatus 10 of the prior art, comprising a side draft barometric damper usable for the horizontal flow of air. FIG. 2 is a view in partial section taken generally along line 2—2 of FIG. 1. For the following discussion of the side draft barometric damper apparatus 10, reference will be made to FIGS. 1 and 2.

The side draft barometric damper apparatus 10 includes four frame members, including a top frame member 12, a bottom frame member 16, and a pair of side frame members 20 and 22. The four frame members are appropriately secured together.

Extending downwardly from the top frame member 12 is a flange 14. A similar flange 18 extends upwardly from the bottom frame member 16.

A plurality of louvers 30 are appropriately secured to and extend between the side frame members 20 and 22. The louvers include a pair of pins 32 which are secured to the louvers and which are appropriately journaled for rotation or pivoting in the side frame members 20 and 22. The louvers 30 pivot on the pins 32 in response to air movement.

Each louver is divided into two portions, a relatively short upstream or top portion 34, and a relatively long or downstream portion 40. The pins 32 comprise the dividing line between the upstream portion 34 and the downstream portion 40. That is, a line drawn between the aligned pins 32 on each louver comprises the dividing line between two portions of the louvers. The pins comprise the pivot points, and a line between the pins comprises the pivot axis. It is the pivot axis that comprises the dividing line between the two portions.

At the outer end or top end of the portion 34, there is a u-bend 36. A counterweight 38 is disposed in the u-bend 36. The counterweight in the u-bend helps to offset the weight of the relatively long or downstream portion 40. That is, the weight of the short upstream or top portion 34 of the louver 30, together with the counterweight 38, helps to offset the weight of the relatively long or downstream portion 40 of the louver 30.

The long or downstream portion 40 terminates in a bottom or downstream edge 42. A length of weatherstripping 44 is disposed along the bottom edge 42 to help seal the louvers as they pivot to their closed position, as best shown in FIG. 2. The weatherstripping 44 is disposed against the u-bend 36 of the adjacent louver as the blades or louvers 30 pivot closed when the air flow stops. Weatherstripping is also typically found on the flange 14.

An enlarged arrow in FIG. 2 shows the direction of the air flow through the barometric damper apparatus 10. When the air flow ceases, the louvers pivot to their closed position, as shown in FIG. 2. When the air flows, the air flow acting on the relatively large or long downstream portion 40 causes the louvers to pivot on their ends 32 to their open position, in which they are generally parallel to each other. This is indicated in phantom in FIG. 2 and by the dotted line arrows adjacent to the louvers 30. With the weight of the two portions 34 and 40 being relatively close, the substantially larger area of the downstream portion 40 causes the louvers to pivot to their open position. However, when the air flow ceases, the slightly greater weight of the downstream portion 40 relative to the upstream portion 34 causes the louvers to pivot to their closed position. It will be noted that the term "upstream" and "downstream" refer to the louver portions in their open position. This terminology will continue throughout the specification.

Stop elements extending inwardly on the side frame element 20 limit the pivoting of the louvers 30 in both their open and closed positions. Stop elements 46 limit the opening, and stop elements 48 limit the closing, of the louvers, or the pivoting of the louvers in the respective directions.

It will be noted that the louver apparatus 10 is limited to the relatively vertical orientation illustrated in FIG. 1, in which the air flow is generally horizontal. If the apparatus 10 were to be disposed horizontally by a clockwise pivoting, the louvers would pivot to their open position even in the absence of an air flow due to the relatively heavier weight of the downstream portion 40 of each louver. This is assuming, of course, that the air flow through the apparatus 10 would be downwardly.

If the air flow were reversed, or were upwardly, or if the apparatus were rotated 180 degrees in the horizontal position from that discussed in the preceding paragraph, the louvers would remain closed at all times.

FIG. 3 is a perspective view of barometric damper apparatus 50 of the prior art which comprises a down draft barometric damper apparatus. The barometric damper apparatus 50 is usable only in its horizontal orientation as illustrated in FIG. 3, in which the air flow is vertically downwardly. FIG. 4 is a view in partial section taken generally along line 4—4 of FIG. 3. For the following discussion of barometric damper apparatus 50, reference will primarily be made to FIGS. 3 and 4.

In FIG. 4, a large arrow illustrates the direction of the air flow. Again, the barometric damper apparatus 50 is disposed generally horizontally and the air flow is downwardly.

The barometric damper apparatus 50 includes four frame members, including an end frame member 52, an end frame member 56, and a pair of side frame members 60 and 62. The end frame members 52 and 56 each include a flange. The end frame member 52 includes a flange 54, and the end frame member 56 includes a flange 58. The purpose of the flanges 56 and 58, and also the flanges 14 and 18 for the end frame member 12 and 16, is to comprise stop elements for the first and last louvers in the barometric damper apparatus. This is shown in FIGS. 1, 2, 3 and 4.

The barometric damper apparatus 50 includes a plurality of louvers 70. The louvers 70 pivot on pins 72. Each louver 70 includes a pair of pins 72, and the pins 72 comprise pivot elements for the louvers. Accordingly, a line drawn between the pins 72 of each louver 70 comprises a pivot axis for the louver.

The pins 72 divide each louver 70 into two portions, a top or upstream portion 74, which is relatively short, and a relatively long bottom or downstream portion 80. The outer end of each louver at the top or upstream portion 74 includes a u-bend 76. A counterweight element 78 is disposed in the u-bend 76.

It will be noted that the counterweights 38 and 78 in the u-bends 36 and 76 are generally aligned with the planes of the louver portions 34, 74 and 40 and 80, of the louvers 30 and 70, respectively. This feature will be contrasted below with a comparable feature in the present invention.

The downstream portion 80 terminates in a bottom or downstream end or edge 82. A length of weatherstripping 84 extends the length of the louver adjacent to the end or edge 82. Weatherstripping also is found on the flange 54. The weatherstripping on the flanges and on the louvers also acts as a sound damper as the louvers close.

As with the barometric damper apparatus 10, the apparatus 50 also includes stop elements for each louver. Stop elements 86 limit the opening or pivoting of the elements in the open direction, and stop elements 88 limit the closing or pivoting of the elements in the closed position.

The various elements of the louver 70 correspond to the various elements of the louvers 30, discussed above.

Air flowing against the louvers 70 as shown by the large arrow in FIG. 4, causes the louvers to pivot to their open position due to the area differential between the relatively short upstream portion 74 and the relatively long downstream portion 80. However, the combined weight of the relatively short upstream portion 74 and its counterweight 78 is slightly greater than the weight of the downstream portion 80. Accordingly, when the air flow ceases, the louvers 70 pivot to their closed position, as shown in FIG. 4.

When the air flows, as indicated by the large arrow in FIG. 4, the louvers pivot to their open position. It will be noted that the open position of the louvers is not quite parallel to the air stream. Similarly, the louvers 30 of the barometric damper apparatus 10 pivot to an open position which is not quite parallel to the air flow, as shown in phantom in FIG. 2. The limit pins or stop elements limit the pivoting of the louvers primarily in the open position. The stop elements simply comprise tabs stamped out of the side frame members and bent ninety degrees inwardly from the frame members. The stop elements need only be on one of the frame members, and thus only contact each louver at one point, due to the relatively light weight of each louver.

From FIG. 4, it will be obvious that the barometric damper apparatus 50 is usable only in the horizontal orientation, with the air flow vertically downwardly. If the damper apparatus 50 were to be pivoted to a vertical orientation by a ninety degree counter clockwise pivoting from that shown in FIG. 4, including the air flow as indicated by the large arrows in FIG. 4, the louvers would pivot to their open position and remain open regardless of the air flow due to the weight distribution on the two portions of each louver. The louvers accordingly would remain open and would not close. On the other hand, if the air flow were to be reversed through the apparatus from that shown, the louvers would remain in their closed position during air flow and would only open in the absence of an air flow.

The apparatus of the present invention, barometric damper apparatus 110, provides or comprises a universal barometric damper apparatus which may be used in both the vertical orientation for horizontal air flow and in the horizontal orientation for vertical air flow without structural changes. The barometric damper apparatus 110 is illustrated in FIGS. 5, 6, 7, 8, and 9. Reference will be made to those Figures for the following discussion.

Figure 6:
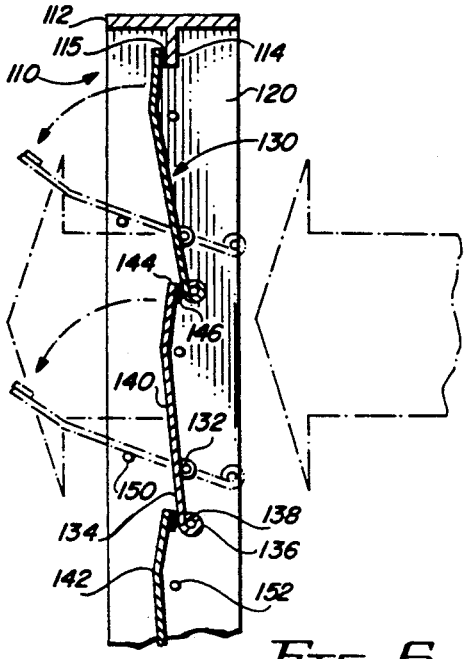
FIG. 6 is a view in partial section taken generally along line 6—6 of FIG. 5

FIG. 5 comprises a perspective view of the barometric damper apparatus 110 in a vertical orientation for air flowing generally horizontally. FIG. 6 comprises a view in partial section taken generally along line 6—6 of FIG. 5. The direction of air flow through the barometric damper apparatus 110 is shown by the relatively large dash-dot arrow in FIG. 6.

Figure 7:
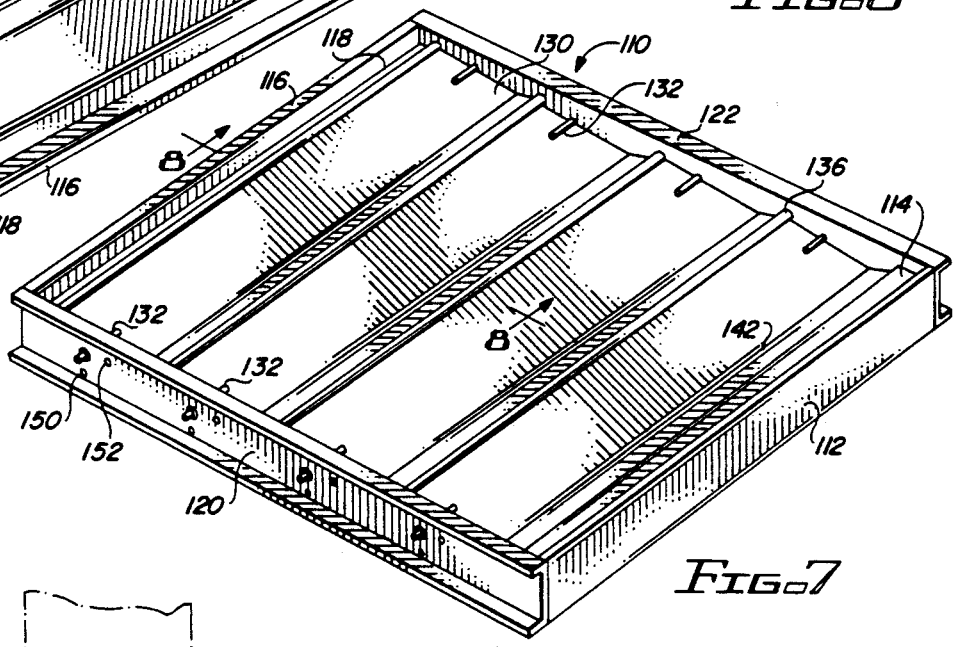
FIG. 7 is a perspective view of the apparatus of FIG. 5 in a generally horizontal orientation.
Figure 8:
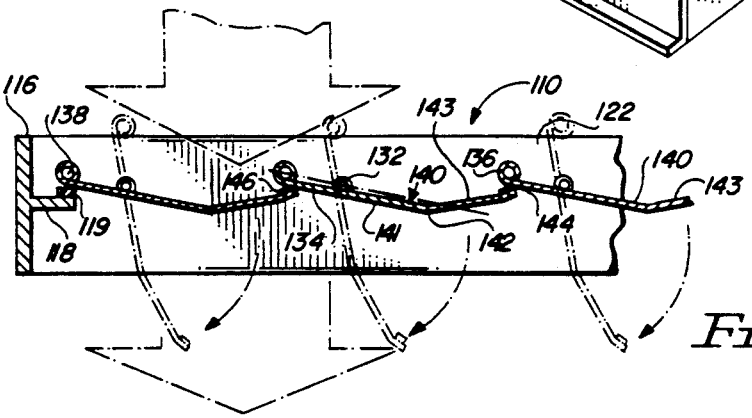
FIG. 8 is a view in partial section taken generally along line 8—8 of FIG. 7.

FIG. 7 comprises a perspective view of the barometric damper apparatus 110 disposed in a horizontal orientation, for air flow moving vertically downwardly. FIG. 8 comprises a view in partial section of a portion of the barometric damper apparatus 110 taken generally along line 8—8 of FIG. 7. The direction of the air flow, downwardly, is shown in FIG. 8 by a pair of relatively large dash-dot arrows. FIG. 9 is a perspective view of a portion of a louver 130.

The barometric damper apparatus 110 includes four frame members, a top or end frame member 112, a bottom or end frame member 116, and a pair of side frame members 120 and 122. The end frame members 112 and 116 include flanges 114 and 118 extending outwardly generally perpendicular to their respective frame members. The purpose of the flanges 114 and 118 is substantially as discussed above for the illustrated flanges 14, 18 and 54, and 58 of the barometric damper apparatus 10 and 50, respectively. The flanges 114 and 118 comprise rest elements against which the louvers are disposed in their closed position and which help to limit the orientation or movement of the louvers 130 in their closed position. That is, the flanges define stop elements for the top and bottom louvers in the closed position. The intermediate louvers of course are disposed against each other, or against adjacent louvers, in the closed position.

The flange 118 includes weather stripping element. A weather stripping element 119 on the flange 118 is shown in FIG. 8.

Each louver 130 includes a pair of pins 132. The pins 132 are appropriately secured to the louvers 130 and comprise the pivot elements on which the louvers pivot. The pins are appropriately journaled for rotation in the side frame elements 120 and 122. A line extending between the pair of pins 132 on each louver 130 defines the pivot axis and separates each louver into a relatively short upstream portion 134 and a relatively long downstream portion 140.

The relatively short upstream louver portion 134 terminates in an end curl 136. A counterweight 138 is disposed in the end curl 136. It will be noted that the end curl 136 extends away from the plane of the louver portions 134 and 140. The louver portions 134 and 140 are aligned in the same plane. The counterweight 138 is offset from the plane of the louver portions 134 and 140. The counterweight 138 is disposed on the same side of the louver portions 134 and 140 as are the pivot pins 132.

The relatively long downstream portion 140 includes a downstream end 144. There is a bend 142 between the pivot axis and the downstream end 144. The bend 142 divides the downstream portion 140 into two sections, including a section 141 which is substantially coplaner with the upstream portion 134 and an angled or offset outer section 143. A louver section 143 extends from the bend 142 to the end 144. The bend 142 is disposed closer to the end 144 than to the pivot axis adjacent to the pins 132. The bend 142 causes the angled section 143 to be disposed on the same side of the louver as is the pin 132 and the counterweight 138. The end 144 is accordingly offset a substantial amount, relatively speaking, from the plane of the louver portion 134 and the adjacent louver section 141 up to the bend 142. Again, this is best shown in FIG. 8.

A length of weather stripping 146 extends the length of the louver 130 and is placed adjacent to the downstream end 144. The purpose of the weatherstripping is for sealing and sound dampening, as discussed above in conjunction with the weatherstripping on the flanges and louver blades of apparatus 10 and 50.

The weight of the relatively short upstream portion 134 and the counterweight 138 is slightly greater than the weight of the relatively long downstream portion 140. Accordingly, when air ceases to flow, the louvers 130 will pivot under gravity until the end curl 136 comes to rest on either a flange of the end frame members or on an adjacent louver. This is shown in both FIGS. 6 and 8. The louvers are also shown in their closed position in FIGS. 5 and 7.

Referring particularly to FIG. 8, a line drawn through the center of a pivot pin 132 and the counterweight 138 extends through the angled or offset portion 143. This is shown by a dash dot line in the middle louver in FIG. 8. The end 144 is accordingly cantilevered outwardly from, or beyond the alignment of, the pivot pin 132 and the counterweight 138. This allows a louver to contact an adjacent louver for sealing purposes and still allows the counterweight 138 to remain off the vertical, as in FIG. 6, or off the horizontal, as in FIGS. 7 and 8, and still have substantial a closing moment to urge the louvers to the closed position in the absence of air flow. Thus, the louvers are urged into a sealing engagement by the offset outer ends. The counterweight is always urging the louvers to the closed position in the absence of air flow regardless of the horizontal or vertical orientation, trying to maintain a seal.

There are stop or limit elements which limit the pivoting of the louvers in both their open and closed positions. The stop elements are typically found on only one side frame member and they comprise simply stamped elements pivoting ninety degrees inwardly from the frame. The stop or limit elements include elements 150 and 152. Stop elements 150 limit the pivoting of the louvers 130 in their open positions and the stop elements 152 limit the pivoting of the louvers in their closed position. In actuality, the stop elements prevent the middle louvers from closing too far or from opening too far in the event that an adjacent louver gets stuck. The stop elements help keep the blades or louvers within their desired range of movement.

It will be noted, as shown best in FIGS. 2, 4, 6, and 8, that the flanges 114 and 118 on the end frame members comprise the primary stop elements to limit the pivoting of the louvers in the closed position.

When air is flowing, the air flow against the relatively substantially larger area of the downstream portions 140 and 143 will cause the louvers 130 to pivot on their pivot pins 132 to the open position in which air flows through the louvers. When the air ceases to flow, the louvers 130 pivot under gravity on their pivot pins 132 to their closed positions.

The orientation of the barometric damper apparatus 110 in horizontal air flow and in vertical air flow are different, of course, and are illustrated in FIGS. 6 and 8. The relatively short upstream portion of each louver is oriented so that it will fall or move or pivot to the closed position in response to gravity. It will be noted from FIG. 6 and 8, and also from FIGS. 2 and 4, that the weather stripping on the louvers is disposed against an adjacent louver to help seal the barometric damper apparatus when there is no positive air flow.

The bend 142 in each louver allows the louver to remain in its closed position and to contact an adjacent louver in the closed position. Typically, the bend or break angle is about fifteen degrees upwardly from the plane of the louver portions 140 and 134.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Barometric damper apparatus for use interchangeably in vertical and horizontal installations comprising, in combination:

frame means for supporting a plurality of movable louvers;

louver means comprising a plurality of louvers movable in the frame means between an open position in response to an air flow in a predetermined direction which allows the air to flow in the predetermined direction and a closed position which prevents air from flowing in the reverse of the predetermined direction, and each louver of the plurality of louvers includes a relatively short upstream portion having a first predetermined area, a first predetermined weight, a first side, and an upstream end;

a counterweight secured to the upstream end on the first side of the upstream portion to pivot the louver to its closed portion in the absence of an air flow in the predetermined direction;

a relatively long downstream portion having a second predetermined area, a second predetermined weight, and having a side continuing the first side of the upstream portion outwardly therefrom for moving the louver to its open position in response to the flow of the air in the predetermined direction;

a pivot axis between the relatively short upstream portion and the relatively long downstream portion, including pivot means secured to the first side;

an outer end on the downstream portion remote from the pivot axis; and a bend in the downstream portion between the outer end and the pivot axis which divides the downstream portion into two sections, a section which is substantially coplanar with the upstream portion and an angled section which is offset in the direction of the counterweight and the pivot means from the upstream portion and the coplanar section of the downstream portion, and the outer end is disposed on the angled section for contacting an adjacent louver for sealing purposes in the absence of an air flow in the predetermined direction.

2. The apparatus of claim 1 in which each louver includes a first end and a second end, and the pivot means includes a pivot pin secured to each louver at the first end and a pivot pin secured to each louver at the second end.

3. The apparatus of claim 2 in which the pivot pins are pivotally secured to the frame means.

4. The apparatus of claim 3 in which a line through the center of the counterweight and the center of the pivot means extends through the angled section.

5. Barometric damper apparatus interchangeably usable in vertical and horizontal orientations comprising, in combination:

frame means for supporting a plurality of louvers including a first end frame member, a second end frame member spaced apart from the first end frame member, a first side frame member secured to the first and second end frame members, and a second side frame member spaced apart from the first side frame member and secured to the first and second end frame members;

a plurality of louvers extending between and pivotally secured to the first and second side frame members, and each louver includes a relatively short upstream portion, a relatively long downstream portion including a section coplanar with the upstream portion and an angled section remote from the upstream portion, a bend in the downstream portion remote from the upstream portion and at the angled section;

pivot means secured to the first and second side frame members and to each louver at the juncture of the upstream and downstream portions on which each louver pivots to an open position in response to a flow of air in a desired direction and to a closed position in the absence of the flow of air in the desired direction; and counterweight means secured to the upstream portion of each louver for pivoting the louver to the closed position in the absence of the flow of air in the desired direction, the counterweight means being disposed offset from the plane of the upstream portion and the coplanar downstream section towards the angled section.

6. The apparatus of claim 5 in which the upstream portion and the downstream portion have predetermined weights, and the upstream portion includes an end, and the counterweight means is secured to the end and provides a predetermined weight for the upstream portion greater than the predetermined weight for the downstream portion to pivot the upstream portion downwardly by gravity in the absence of the flow of air in the desired direction to close the damper apparatus by having the angled section of each louver disposed against an adjacent louver.

7. The apparatus of claim 6 in which the frame means further includes a flange extending from the first end frame member, and the plurality of louvers includes a top louver having its angled section disposed against the flange when the damper apparatus is closed.

8. The apparatus of claim 5 in which the upstream portion of each louver includes an upstream end, and the counterweight means is secured to the upstream end.

* * * * *